US007297905B2

(12) United States Patent
Kim et al.

(10) Patent No.: US 7,297,905 B2
(45) Date of Patent: Nov. 20, 2007

(54) METHOD AND APPARATUS FOR MAINTAINING A TEMPERATURE IN A CHAMBER OF A COOKING DEVICE

(75) Inventors: Cheol Jin Kim, Suwon-Si (KR); Kobayashi Shozo, Suwon-Si (KR); Yun Ic Hwang, Suwon-Si (KR); Seok Weon Hong, Yongin-Si (KR); Yu Jeub Ha, Suwon-Si (KR); Hyun Suk Kim, Yongin-Si (KR); Pung Yeun Cho, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 12 days.

(21) Appl. No.: 11/156,475

(22) Filed: Jun. 21, 2005

(65) Prior Publication Data

US 2006/0027559 A1 Feb. 9, 2006

(30) Foreign Application Priority Data

Aug. 4, 2004 (KR) ..... 10-2004-0061503

(51) Int. Cl.
*A21B 1/26* (2006.01)
*A21B 3/04* (2006.01)
*A21B 1/50* (2006.01)

(52) U.S. Cl. ..... 219/400; 219/394; 219/413; 126/21 A; 99/474

(58) Field of Classification Search ..... 219/394
See application file for complete search history.

(56) References Cited

U.S. PATENT DOCUMENTS 1,637,427 A * 8/1927 Riches et al. ..... 219/394
3,958,552 A * 5/1976 Lawler ..... 126/247
4,331,124 A * 5/1982 Seidel et al. ..... 126/21 A
4,484,563 A 11/1984 Fritz et al.
5,451,744 A * 9/1995 Koopman et al. ..... 219/400
5,528,018 A * 6/1996 Burkett et al. ..... 219/413
5,618,458 A * 4/1997 Thomas ..... 219/394
5,994,673 A * 11/1999 El-Shoubary et al. ..... 219/403
6,545,251 B2 * 4/2003 Allera et al. ..... 219/394
2001/0039884 A1 * 11/2001 Backus et al. ..... 99/421 H
2002/0060215 A1 * 5/2002 Allera et al. ..... 219/394
2004/0245247 A1 * 12/2004 Rawal ..... 219/757

FOREIGN PATENT DOCUMENTS

KR 85-7988 10/1985

(Continued)

OTHER PUBLICATIONS

Korean Patent Abstracts: Dae Sik Kim, "Air Flow System for Microwave Oven", Publication No. 2002-50025, Publication Date Jun. 26, 2002. Abstract Only.

(Continued)

*Primary Examiner*—J. Pelham
(74) *Attorney, Agent, or Firm*—Staas & Halsey LLP

(57) ABSTRACT

A cooking device having a cooking compartment, which is divided by a partition. The cooking device includes a partitioning member, installed in a cooking chamber, for partitioning the cooking chamber into a first cooking chamber and a second cooking chamber, a heater for heating food placed in the cooking chamber, and a ventilating device for ventilating air in the first cooking chamber and the second cooking chamber, independently.

9 Claims, 3 Drawing Sheets

FOREIGN PATENT DOCUMENTS

| | | |
|---|---|---|
| KR | 1986-0000773 | 4/1986 |
| KR | 1998-064790 | 11/1998 |
| KR | 1999-0083670 | 12/1999 |
| KR | 2002-50025 | 6/2002 |
| KR | 20-343492 | 3/2004 |

OTHER PUBLICATIONS

Korean Patent Abstracts: Joong-Woo An, "Multi-Function Barbeque Cooker Capable of Using Heat Twice", Publication No. 1999-83670, Publication Date Dec. 6, 1999. Abstract & Partial Translation Only.

Korean Patent Abstracts: Woong-Tak Lim, "Exhausting and Cooling Structure of Oven", Registration No. 20-343492, Publication Date Mar. 2, 2004. Abstract & Partial Translation Only.

Korean Patent Abstracts: Jong-Joo An, "Barbecue Cooling Apparatus With Seperable Preheating Chamber and Cooking Chamber", Publication No. 1998-64790, Publication Date Nov. 25, 1998. Abstract & Partial Translation Only.

Korean Patent Abstracts: Hisao Hiyashi, et al., "COOKER", Publication No. 1986-773, Publication Date Apr. 30, 1986. Abstract & Partial Translation Only.

* cited by examiner

METHOD AND APPARATUS FOR MAINTAINING A TEMPERATURE IN A CHAMBER OF A COOKING DEVICE

CROSS-REFERENCE TO RELATED APPLICATIONS

This application claims the benefit of Korean Patent Application No. 2004-61503, filed on Aug. 4, 2004 in the Korean Intellectual Property Office, the disclosure of which is incorporated herein by reference.

BACKGROUND OF THE INVENTION

1. Field of the Invention

The present invention relates to a cooking device, and more particularly to a cooking device in which a cooking compartment is divided by a partition.

2. Description of the Related Art

In a cooking device, such as a microwave oven or an electric oven, it is desirable to have a cooking chamber in a housing and a heating device for heating the food to be placed in the cooking chamber. The cooking chamber is divided into an upper cooking chamber and a lower cooking chamber by a partition so that the space in the cooking chamber can be effectively utilized.

Moreover, recently, a cooking device has been developed which has heating devices installed in the upper cooking chamber and the lower cooking chamber and capable of controlling temperature in the respective cooking chambers independently. Different foods are placed in the upper cooking chamber and the lower cooking chamber, respectively, and heated at different temperatures simultaneously, so that various foods can be cooked rapidly.

According to the conventional cooking device, since the upper cooking chamber and the lower cooking chamber are heated at different temperatures, heat is transferred through the partition. This heat transfer affects the temperature in the respective cooking chambers so that the temperatures in the cooking chambers cannot be precisely controlled.

SUMMARY OF THE INVENTION

Additional aspects and/or advantages of the invention will be set forth in part in the description which follows and, in part, will be apparent from the description, or may be learned by practice of the invention.

Exemplary embodiments have been made in view of the above-mentioned problems, and an aspect of the invention is to provide a cooking device capable of independently controlling temperatures in respective cooking chambers by installing separate ventilating devices in the respective cooking chambers.

In accordance with one aspect, exemplary embodiments of the present invention provide a partitioning member, installed in a cooking chamber, for partitioning the cooking chamber into a first cooking chamber and a second cooking chamber, a heater for heating food to be placed in the cooking chamber, and a ventilating device for ventilating air in the first cooking chamber and the second cooking chamber, independently.

Exemplary embodiments of a cooking device may further include a controller for controlling the heater to maintain the second cooking chamber at a predetermined temperature.

Moreover, the controller may be set to drive the ventilating device when the second cooking chamber is not maintained at the predetermined temperature due to heat transfer from the first cooking chamber to the second cooking chamber.

The controller may be set to stop the ventilating device when the temperature in the second cooking chamber is under the predetermined temperature due to the operation of the ventilation device.

The cooking device, according to exemplary embodiments of the present invention, may further include a controller for driving the heater when the temperature in the second cooking chamber is under a predetermined temperature, and for driving the ventilating device when the temperature in the second cooking chamber exceeds the predetermined temperature.

The cooking device, according to exemplary embodiments of the present invention, may further include a controller for controlling the ventilating device to ventilate the air in the cooking chamber at a predetermined time interval.

Exemplary embodiments of a partitioning member may have a partition for dividing the cooking chamber into an upper cooking chamber and a lower cooking chamber.

The heater may include an upper heating section for heating the food placed in the upper cooking chamber, and a lower heating section for heating the food placed in the lower cooking chamber.

The ventilating device may include an air intake pipe for communicating an air intake hole formed at the front side of the cooking device with the cooking chamber, and a blower, installed at an intermediate portion of the air intake pipe, for ventilating the air in the cooking chamber by force.

The air intake pipe may be branched into a first branch pipe communicated with the first cooking chamber, and a second branch pipe communicated with the second cooking chamber, and the cooking device may further include a valve, installed at a branched point of the air intake pipe, for selectively communicating the air intake hole with the first cooking chamber or the second cooking chamber.

To achieve the above and/or other aspects and advantages, embodiments of the present invention may include a method for maintaining the temperature in a first cooking chamber of a cooking device including at least first and second cooking chambers, the method including supplying heat to first and second cooking chambers; measuring the temperature in the first chamber; comparing the temperature in the first cooking chamber to a first predetermined temperature; and ventilating air into the first cooking chamber until the temperature in the first cooking chamber equals the predetermined temperature.

The air may be prevented from reaching the first cooking chamber when the temperature of the first cooking chamber equals the first predetermined temperature.

The method may further comprise measuring the temperature in the second cooking chamber; comparing the temperature in the second cooking chamber to a second predetermined temperature; and ventilating air into the second cooking chamber until the temperature in the second cooking chamber equals the predetermined temperature.

The air may be prevented from reaching the second cooking chamber when the temperature of the first cooking chamber equals the second predetermined temperature.

The method may further include the operation of exhausting air in the first cooking chamber at a predetermined time interval.

The method may further include exhausting air in the first cooking chamber at a predetermined time interval, and exhausting air in the second cooking chamber at a different predetermined time interval.

To achieve the above and/or other aspects and advantages, embodiments of the present invention may include a cooking device may include a cooking chamber; a partition, which is installed in a cooking chamber, and which divides the cooking chamber into a first cooking chamber and a second cooking chamber; a first heating section supplying heat to the first cooking chamber, and a second heating section supplying heat to the second cooking chamber; an intake supplying air outside of the cooking chamber to at least one of the first and second cooking chambers; an exhaust which exhausts air from at least one of the first and second cooking chambers; and a first temperature sensor sensing the temperature in one of the first and second cooking chambers; and a controller controlling the intake to at least one of the first and second cooking chambers based on a comparison of the temperature sensed by the first temperature sensor and a first predetermined temperature.

The first temperature sensor may be installed in the first cooking chamber, and the cooking device may further comprise a second temperature sensor, which may be installed in the second cooking chamber.

The controller may control the intake to the first cooking chamber based on the comparison of the temperature sensed by the first temperature sensor and a first predetermined temperature, and may control the intake to the second cooking chamber based on another comparison of the temperature sensed by the second temperature sensor and a second predetermined temperature.

The controller may exhaust air in at least one of the first cooking chamber and second cooking chamber at a predetermined time interval.

The controller may exhaust air in the first cooking chamber at a predetermined time interval, and may exhaust air in the second cooking chamber at a different predetermined time interval.

BRIEF DESCRIPTION OF THE DRAWINGS

These and/or other aspects and advantages of the invention will become apparent and more readily appreciated from the following description of exemplary embodiments, taken in conjunction with the accompanying drawings of which.

DETAILED DESCRIPTION OF THE PREFERRED EMBODIMENTS

Figure 1:
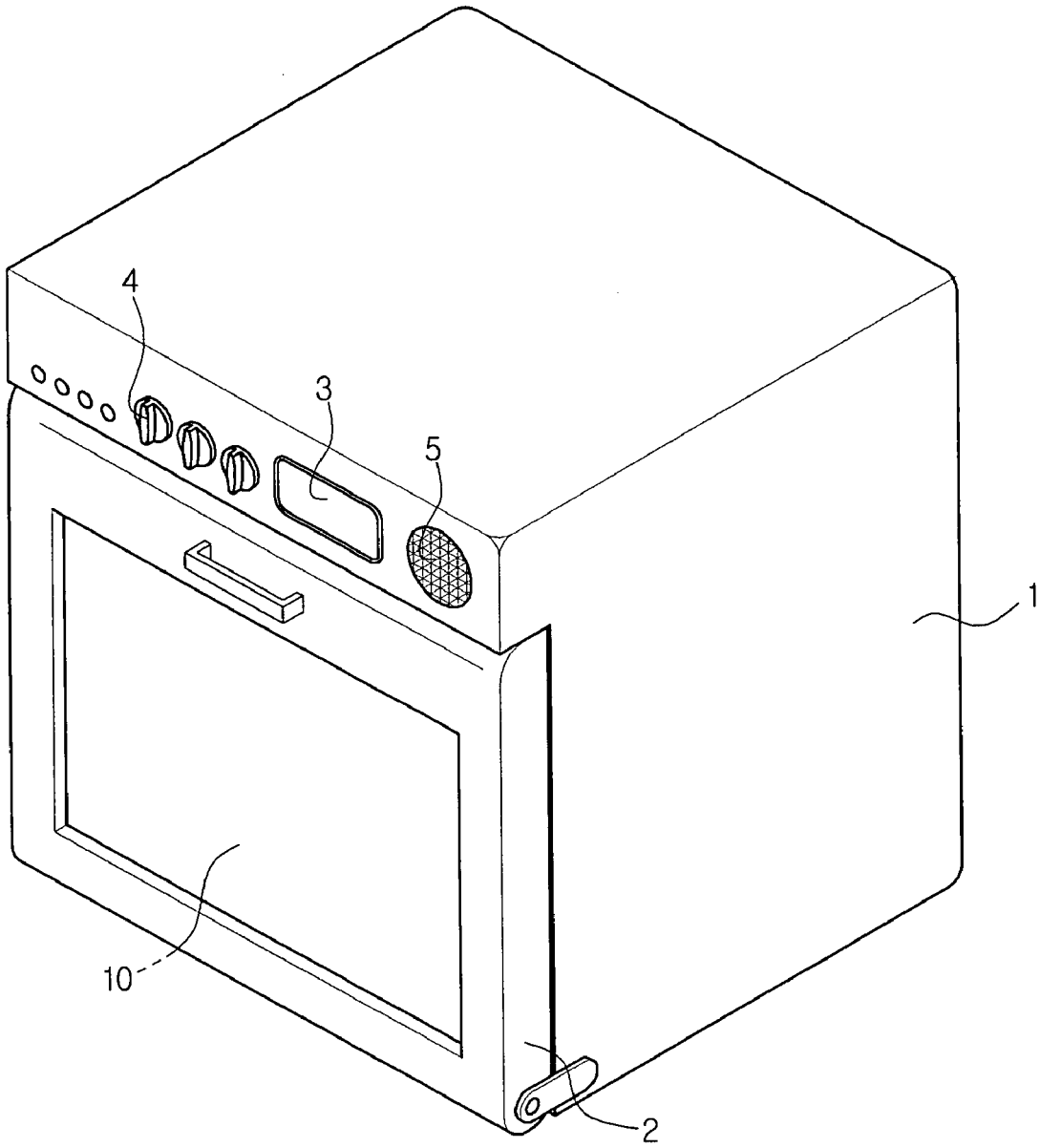
FIG. 1 is a perspective view illustrating an exemplary embodiment of a cooking device, according to the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

An exemplary embodiment of a cooking device, according to the present invention, as shown in FIG. 1, is formed with a cooking chamber 10 at the lower side of a main body housing 1. A door 2 is installed at the front side of the cooking chamber 10, to pivot upward and downward so as to open and close the cooking chamber 10. At the front upper side of the cooking chamber 10, a manipulation section 4 for controlling the temperature in the cooking chamber 10 by a user and a display 3 for displaying the cooking status information are installed. An air-intake hole 5 is formed at the right side of the display 3.

Figure 2:
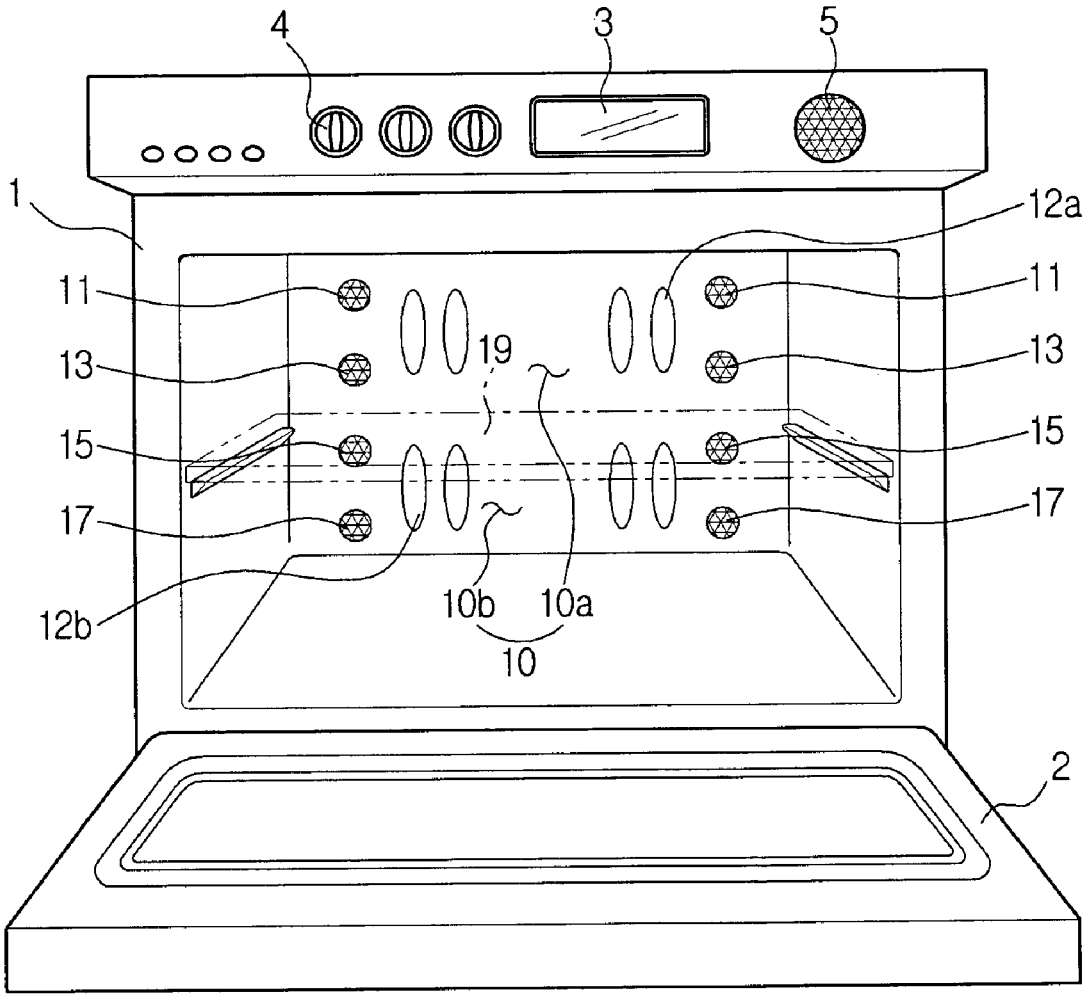
FIG. 2 is a perspective view illustrating an exemplary embodiment of the inside of the cooking chamber of the cooking device, according to the present invention.

The cooking chamber 10, as shown in FIG. 2, is installed with a partition 19. The partition 19 divides the cooking chamber 10 into an upper cooking chamber 10*a* and a lower cooking chamber 10*b*. The user places the food on the partition 19 when cooking the food in the upper cooking chamber 10*a*, and places the food on the bottom of the cooking chamber 10 when cooking the food in the lower cooking chamber 10*b*, and then heats the food in the cooking chamber 10.

Rear walls of the upper cooking chamber 10*a* and the lower cooking chamber 10*b* are formed with an upper hole 12*a* and a lower hole 12*b*, respectively. Heated hot air is introduced through the upper hole 12*a* and the lower hole 12*b*. An upper exhaust port 11 and an upper intake port 13 are formed to suck and exhaust air by communicating the interior of the upper cooking chamber 10*a* with the exterior, and a lower exhaust port 15 and a lower intake port 17 are formed to suck and exhaust air by communicating the interior of the lower cooking chamber 10*b* with the exterior.

Figure 3:
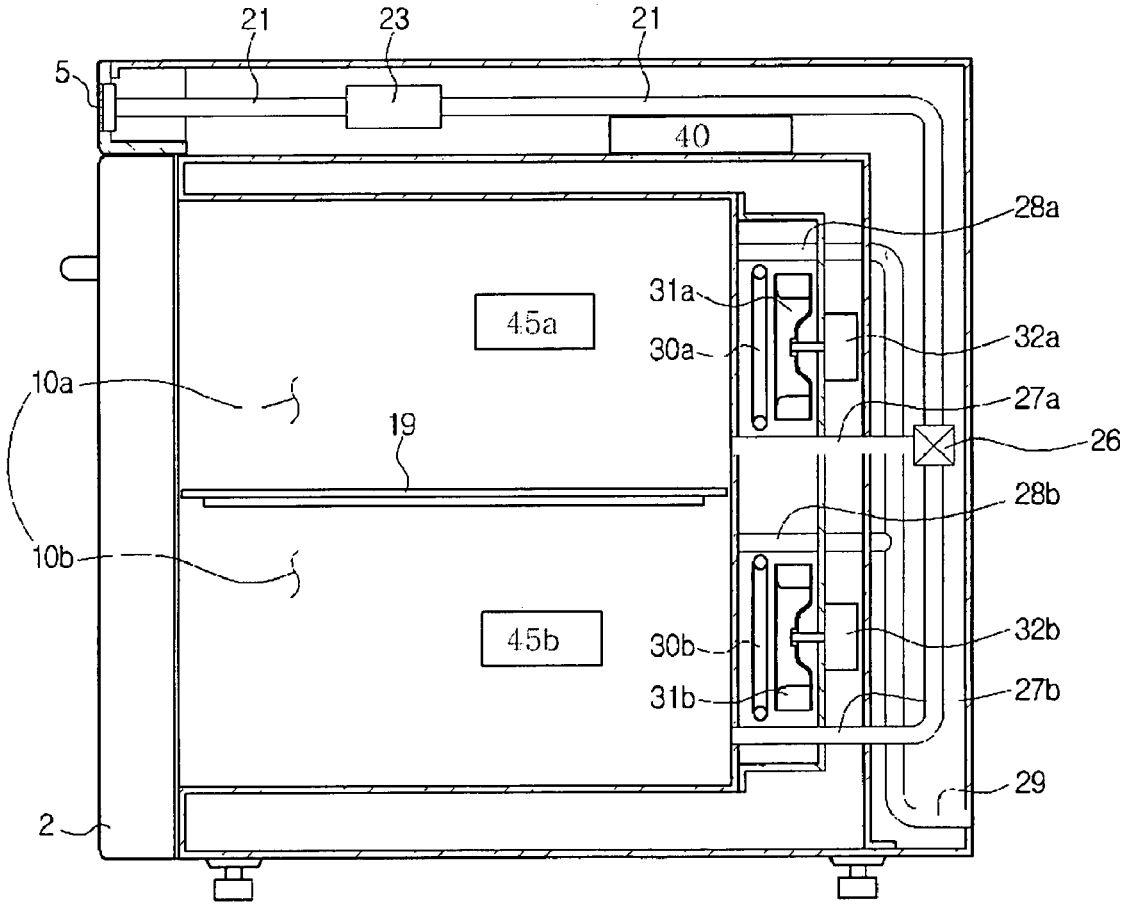
FIG. 3 is a side cross-sectional view illustrating an exemplary embodiment of the inner structure of the cooking device, according to the present invention.

As shown in FIG. 3, an intake pipe 21 extends from the intake hole 5 formed at the front side of the main body 1 to a rear inside of the main body 1, and a blower 23 is installed at an intermediate portion of the intake pipe 21, so as to suck the exterior air by force. The intake pipe 21 is branched into an upper branch pipe 27*a* and a lower branch pipe 27*b*, and is installed with a valve 26 at the branching point. The valve 26 selectively communicates the intake pipe 21 with either the upper branch pipe 27*a* or the lower branch pipe 27*b*, or communicates the intake pipe 21 with both the upper branch pipe 27*a* and the lower branch pipe 27*b*.

As shown in FIGS. 2 and 3, the upper branch pipe 27*a* is communicated with the upper cooking chamber 10*a* via the upper intake hole 13, and the lower branch pipe 27*b* is communicated with the lower cooking chamber 10*b* via the lower intake hole 17. Thus, the outside air introduced into the main body 1 through the intake hole 5 may be supplied to the upper cooking chamber 10*a* and the lower cooking chamber 10*b*, independently.

Moreover, an upper exhaust pipe 28*a* and a lower exhaust pipe 28*b* are installed at rear sides of the upper cooking chamber 10*a* and the lower cooking chamber 10*b*, respectively. The upper exhaust pipe 28*a* and the lower exhaust pipe 28*b* are joined to each other so as to form a single exhaust pipe 29. The upper exhaust pipe 28*a* is communicated with the upper cooking chamber 10*a* via the upper exhaust port 11, and the lower exhaust pipe 28*b* is communicated with the lower cooking chamber 10*b* via the lower exhaust port 15. Thus, the outside air supplied to the upper cooking chamber 10*a* and the lower cooking chamber 10*b* is circulated within the upper cooking chamber 10*a* and the lower cooking chamber 10*b*, and then exhausted to the exterior via the exhaust pipe 29.

Further, an upper heating section 30*a* for heating food placed in the upper cooking chamber 10*a* and a lower heating section 30*b* for heating food to be placed in the lower cooking chamber 10*b* are installed at rear sides of the upper cooking chamber 10*a* and the lower cooking chamber 10*b*, respectively. When electric power is supplied, the temperature of the heating sections 30*a* and 30*b* is increased. Blower fans 31*a* and 31*b* and motors 32*a* and 32*b* installed at rear sides of the heating sections 30*a* and 30*b* blow heated ambient air around the heating sections 30*a* and 30*b* into the cooking chamber 10. At this time, the heated ambient air around the heating sections 30*a* and 30*b* is supplied into the cooking chamber 10 via the upper hole 12*a* and the lower hole 12*b*.

To use the cooking device constructed as described above, the foods are placed in the upper cooking chamber 10*a* and the lower cooking chamber 10*b*, respectively. The foods placed in the cooking chambers 10*a* and 10*b* are cooked by being heated at predetermined temperatures. If the food placed in the upper cooking chamber 10*a* is set to be heated at 300 degrees centigrade, and the food placed in the lower cooking chamber 10*b* is set to be heated at 120 degrees centigrade, heat is transferred from the upper cooking chamber 10*a* to the lower cooking chamber 10*b* via the partition 19.

If the heat is continuously transferred, the temperature in the lower cooking chamber 10*b* cannot be maintained at a proper temperature, that is, 120 degrees centigrade, even when the electric power to be supplied to the lower cooking chamber 10*b* is cut off. Thus, if a proper amount of outside air is supplied into the lower cooking chamber 10*b* via the lower intake hole 17, the air temperature in the lower cooking chamber 10*b* is lowered. When the air temperature in the lower cooking chamber 10*b* is lowered to the predetermined temperature, that is, 120 degrees centigrade, the valve 26 is closed so as to halt the introduction of the outside air into the lower cooking chamber 10*b*. This process may be performed by installing a temperature sensor 45*a* in the upper cooking chamber 10*a* and a temperature sensor 45*b* in the lower cooking chamber 45*b*, and by providing a controller 40 for driving the blower 23 and closing/opening the valve 26 by using information about the temperature received from at least one of the temperature sensors 45*a* and 45*b*.

Moreover, since it is difficult to hermetically seal the upper cooking chamber 10*a* and the lower cooking chamber 10*b* by using the partition 19, there may be an air stream present between the upper cooking chamber 10*a* and the lower cooking chamber 10*b*. Therefore, since the smell of the food placed in the upper cooking chamber 10*a* may be mixed with the smell of the food placed in the lower cooking chamber 10*b*, the inherent smell of the food to be cooked may be lost. Even in this case, this problem can be solved by exhausting the air in the upper cooking chamber 10*a* and the lower cooking chamber 10*b* at a predetermined time interval. Further, this function can be automatically performed by the controller 40.

As described above, according to exemplary embodiments of the cooking device of the present invention, the temperatures in the respective cooking chambers can be independently controlled by installing independent ventilating devices in the respective cooking chambers.

Moreover, the food placed in one cooking chamber can be prevented from absorbing the smell of the food placed in the other cooking chamber due to the air stream between the cooking chambers.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. A cooking device comprising:

a partitioning member, installed in a cooking chamber, for partitioning the cooking chamber into a first cooking chamber and a second cooking chamber;

means for heating food to be placed in the cooking chamber; and means for ventilating air in the first cooking chamber and the second cooking chamber, independently, wherein the ventilating means comprises:

an air intake pipe for communicating an air intake hole formed at a front side of the cooking device with the cooking chamber; and a blower, installed at an intermediate portion of the air intake pipe, for ventilating the air in the cooking chamber by force.

2. The cooking device as set forth in claim 1, wherein the air intake pipe is branched into a first branch pipe communicated with the first cooking chamber, and a second branch pipe communicated with the second cooking chamber, and further comprising a valve, installed at a branched point of the air intake pipe, for selectively communicating the air intake hole with the first cooking chamber or the second cooking chamber.

3. A method for maintaining the temperature in a first cooking chamber of a cooking device including at least first and second cooking chambers, the method comprising:

supplying heat to first and second cooking chambers;

measuring the temperature in the first chamber;

comparing the temperature in the first cooking chamber to a first predetermined temperature;

ventilating air into the first cooking chamber until the temperature in the first cooking chamber equals the predetermined temperature; and exhausting air in the first cooking chamber at a predetermined time interval.

4. A method for maintaining the temperature in a first cooking chamber of a cooking device including at least first and second cooking chambers, the method comprising:

supplying heat to first and second cooking chambers;

measuring the temperature in the first chamber;

comparing the temperature in the first cooking chamber to a first predetermined temperature;

ventilating air into the first cooking chamber until the temperature in the first cooking chamber equals the predetermined temperature;

measuring the temperature in the second cooking chamber;

comparing the temperature in the second cooking chamber to a second predetermined temperature;

ventilating air into the second cooking chamber until the temperature in the second cooking chamber equals the predetermined temperature; and exhausting air in the first cooking chamber at a predetermined time interval, and exhausting air in the second cooking chamber at a different predetermined time interval.

5. A cooking device comprising:

a cooking chamber;

a partition, which is installed in a cooking chamber, and which divides the cooking chamber into a first cooking chamber and a second cooking chamber;

a first heating section supplying heat to the first cooking chamber, and a second heating section supplying heat to the second cooking chamber;

an intake supplying air outside of the cooking chamber to at least one of the first and second cooking chambers;

an exhaust which exhausts air from at least one of the first and second cooking chambers;

a first temperature sensor sensing the temperature in one of the first and second cooking chambers; and a controller controlling the intake to at least one of the first and second cooking chambers based on a comparison of the temperature sensed by the first temperature sensor and a first predetermined temperature.

6. The cooking device as set forth in claim 5, wherein the first temperature sensor is installed in the first cooking chamber, and further comprising a second temperature sensor, which is installed in the second cooking chamber.

7. The cooking device as set forth in claim 6, wherein the controller controls the intake to the first cooking chamber based on the comparison of the temperature sensed by the first temperature sensor and a first predetermined temperature, and controls the intake to the second cooking chamber based on another comparison of the temperature sensed by the second temperature sensor and a second predetermined temperature.

8. The cooking device as set forth in claim 5, wherein the controller exhausts air in at least one of the first cooking chamber and second cooking chamber at a predetermined time interval.

9. The cooking device as set forth in claim 7, wherein the controller exhausts air in the first cooking chamber at a predetermined time interval, and exhausts air in the second cooking chamber at a different predetermined time interval.

* * * * *